US006173831B1

(12) United States Patent
Grabscheid et al.

(10) Patent No.: US 6,173,831 B1
(45) Date of Patent: Jan. 16, 2001

(54) ENDLESS BELT

(75) Inventors: Joachim Grabscheid, Gerstetten; Volker Schmidt-Rohr, Heidenheim, both of (DE)

(73) Assignee: Voith Sulzer Papiertechnik Patent GmbH, Heidenheim (DE)

( * ) Notice: Under 35 U.S.C. 154(b), the term of this patent shall be extended for 0 days.

(21) Appl. No.: 09/314,125

(22) Filed: May 19, 1999

(30) Foreign Application Priority Data

May 28, 1998 (DE) ..... 198 23 948

(51) Int. Cl.[7] ..... B65G 15/30
(52) U.S. Cl. ..... 198/844.1; 198/846; 162/351
(58) Field of Search ..... 198/844.1, 846, 198/847, 848; 162/203, 300, 301, 348, 351

(56) References Cited

U.S. PATENT DOCUMENTS

| | | | | |
|---|---|---|---|---|
| 1,143,931 | | 6/1915 | Babcock . | |
| 2,694,345 | | 11/1954 | Hornbostel . | |
| 4,714,521 | | 12/1987 | Fujiwara . | |
| 4,922,304 | * | 5/1990 | Gilbert et al. | 198/844.1 X |
| 4,957,199 | * | 9/1990 | Wokke et al. | 198/844.1 X |
| 5,647,958 | | 7/1997 | Schmidt-Rohr et al. . | |
| 5,853,849 | * | 12/1998 | Nishio et al. | 198/846 X |

FOREIGN PATENT DOCUMENTS

| | | |
|---|---|---|
| 3590589 | 10/1986 | (DE) . |
| 4411621 | 10/1995 | (DE) . |
| 4420801 | 12/1995 | (DE) . |
| 19634349 | 3/1998 | (DE) . |

* cited by examiner

*Primary Examiner*—James R. Bidwell
(74) *Attorney, Agent, or Firm*—Greenblum & Bernstein, P.L.C.

(57) ABSTRACT

There is provided an endless belt for use in the production of a web of fibrous material. The belt has first and second sides. The first side is substantially open and the second side is substantially closed. The belt has a water storage capacity of at least 5 $l/m^2$. The belt also has a mean flexural rigidity for a circumferential direction and direction cross-wise of the belt, based on a width of 1 meter each, each of which is no greater than approximately 10 $Nm^2$.

39 Claims, 4 Drawing Sheets

ENDLESS BELT

CROSS-REFERENCE OF RELATED APPLICATIONS

The present application claims priority under 35 U.S.C. § 119 of German Patent Application No. 198 23 948.3, filed May 28, 1998, the disclosure of which is expressly incorporated by reference herein in its entirety.

1. Field of the Invention

The present invention is directed to an endless belt. More specifically, the present invention is directed to an endless belt for use in a drainage section of a machine that manufactures a web of fibrous material, such as paper, cardboard, or tissue.

2. Discussion of the Background Information

In the forming section of a paper making machine, endless belts circulate through the machines relative to wire belts. The endless belts are mounted on the side of a wire belt opposite the side that supports a pulp suspension. Wear caused by stationary elements (e.g., rails, foils, etc.) is therefore supposed to be prevented.

DE 35 90 589 C2 discloses a forming section having two wire belts that form a so-called double-wire zone in which the pulp suspension is drained toward both sides of the belt. To improve the paper characteristics, part of the drainage section is covered with a water-impermeable belt to prevent drainage in that section. A disadvantage of this structure is that, because of the covered area, the length of the entire drainage section must be relatively large, and is not very efficient.

DE 44 20 801 C2 discloses a double-wire zone in which a belt supports a wire belt, which may be either water-permeable or water-impermeable. The water-impermeable belt impairs paper quality by an entrained boundary layer of air, and prevents two-sided drainage. While a water-permeable belt (e.g., perforated) certainly permits drainage, a large amount of water can accumulate in the initial drainage zone, which can undesirably mark the web due to the high flow speeds.

DE 44 11 621 A1 discloses a paper making machine in which a pressing belt in the forming section has an adjacent pressing felt, which absorbs part of the water. The remaining water is stored in the grooves of the pressing belt. Here, the ratio of the surface area of the grooves to the overall surface of the belt should be as small as possible to obtain an adequately large support surface necessary for low belt wear. Such a belt design is suitable for high press pressures and low drainage rates. However, greater drainage flows, such as occurring in the forming section, cannot be properly managed. Increasing the belt thickness would increase the water absorption, but would produce a belt with excessive flexural rigidity tat prevents the required uniform drainage over the width of the belt.

DE-A-196 34 349 discloses, on the side of the wire belt opposite the suspension, a profiled belt running at right angles to the wire belt. The profiled belt is provided with a plurality of holes, borings, or slots, and is thus mostly open. The profile belt may also have a rough, ribbed, or otherwise profiled outer surface facing the wire belt, which may be water impermeable.

SUMMARY OF THE INVENTION

It is accordingly an object of the invention to overcome the drawbacks of the prior art.

It is also an object of the invention to provide an endless belt with two-sided uniform drainage without impairing the quality of the web of fibrous material.

The above and other objects are met by providing an endless belt that is substantially closed on one side, and is substantially open on the opposite side. A water storage capacity of the belt is at least approximately 5 $l/m^2$, particularly within a range of from approximately 5–25 $l/m^2$, and preferably within a range of from approximately 10–18 $l/m^2$. A mean flexural rigidity in the circumferential direction and in the transverse direction, based on a distance of 1 meter in each direction, is less than or equal to approximately 10 $Nm^2$ per one meter distance.

The mean flexural rigidity in the circumferential direction may be the same as the mean flexural rigidity in the transverse direction. However, the flexural rigidity in the circumferential direction and the flexural rigidity in the transverse direction may also be different from each other.

The belt of the present invention may be provided with grooves, particularly on its open side. At least some of the grooves may run generally in the circumferential direction and/or generally the transverse direction. According to an exemplary embodiment of the belt according to the invention, grooves run generally in both the circumferential and cross-wise directions. In principle, the grooves may also be arranged to form a spiral.

In an exemplary embodiment of the belt according to the invention, at least some of the grooves have a depth which is within a range from approximately 5–25 mm, and particularly within a range from approximately 12–20 mm, to provide the necessary water storage capacity.

On its open side, the belt may also have a plurality of knobs or be formed by a plurality of such knobs. This structure reduces flexural rigidity in the circumferential and the transverse direction while providing a high water storage capacity. These may, for example, be disposed in rows running generally in the circumferential direction and generally in the transverse direction. A spiral arrangement of the knobs is also possible. The drainage wire in question is then carried by the contact surface of the knobs coming into contact with the wire.

Because of this design, not only is marking-free two-sided drainage possible, but it ensures that the flexural rigidity in the circumferential direction and in the transverse direction is small enough to be able to set optimal drainage conditions over the entire width.

In an exemplary embodiment of the belt according to invention, the outer contact surface of the knobs which can be brought into contact with a wire is on the whole less than or equal to approximately 50% of the entire surface of the belt particularly within a range of approximately 15–30% and preferably within a range of approximately 20–25% of the entire surface of the belt.

The individual contact surfaces of the knobs preferably have a maximum dimension of approximately 6 mm in any direction. The maximum dimension of the individual contact surfaces of the knobs is thus preferably restricted to a value which is less than or equal to approximately 6 mm, and particularly approximately 2 mm for any individual contact surface.

The individual contact surfaces of the knobs may, for example, have around, square, or rectangular shape, whereby the contact surfaces of the various knobs may be the same or different.

It is also preferable if the belt has compressibility of approximately 100 to 2000 kPa.

The base of the belt may also have a reinforcement on which the knobs are disposed. The reinforcement may include reinforcement fibers, which are preferably embedded in a matrix and run in both the circumferential and transverse directions. The matrix may be made of polyurethane, or a combination of polyurethane and other materials.

To minimize manufacturing expenses, it is preferable that the knobs are formed by machining a base to remove excess material.

Preferably, the base has a thickness within a range of from approximately 0.5–8 mm, and particularly 4 mm thick. The thickness of the wire in contact with the belt is preferably approximately 0.7 mm.

The knobs also preferably include an internal gas cushion, such as an air cushion. This gas cushion may be ventilated from the side and/or toward the closed side of the belt.

To improve the wire carrying function of the belt, the contact surfaces of the knobs may be formed at least partially by spikes embedded in the knobs. By appropriate design and purposeful selection of material of the spikes, belt wear and the tendency toward marking may be reduced. The spikes can be slotted at least in the region of the contact surface, whereby the contact surface bearing the associated wire is further reduced. Such a slotted design is particularly advantageous when the individual contact surfaces of the knobs have a maximum dimension of approximately 2 mm in any direction.

The present invention provides an endless belt for use in the production of a web of fibrous material. The belt has first and second sides. The first side is substantially open and the second side is substantially closed. The belt has a water storage capacity of at least approximately 5 $l/m^2$. The belt also has a mean flexural rigidity for a circumferential direction and cross-wise (i.e., transverse) directions of the belt, based on a distance of 1 meter in each direction, each of which is no greater than approximately 10 $Nm^{2.}$ The exemplary embodiment has various preferable features. The water storage capacity is between approximately 5–25 $l/m^2$, and particularly approximately 10–18 $l/m^2$. The mean flexural rigidity in the circumferential direction equals, or does not equal, the mean flexural rigidity in the cross-wise direction.

At least one groove may be formed on the first side. At least one of the at least one groove may run in the circumferential direction, cross-wise direction, both the circumferential direction and the cross-wise direction, or in a spiral direction. At least one of the at least one groove can have a height within a range of from approximately 5–25 mm, and particularly approximately 12–20 mm.

A plurality of knobs may be provided on the first side. The plurality of knobs can be disposed in rows running substantially in both the circumferential direction and the cross-wise direction, or in a spiral. An outer contact surface of the plurality of knobs can be brought into contact with a wire belt, where a total surface area of a contact surface of the plurality of knobs is no greater than 50% of the total surface area of the endless belt, particular approximately 15–30% of the total surface area of the endless belt, and preferably approximately 20–25% of the total surface area of the endless belt. Each contact surface of the plurality of knobs has a preferable maximum dimension of approximately 6 mm in any direction, and particularly a largest dimensions of approximately 2 mm. Each contact surface of the plurality of knobs preferably has one of a round, square, or rectangular shape. The plurality of knobs are preferably formed by machining the base to remove excess material.

The belt preferably has a compressibility of between approximately 100–2000 kPa.

The belt preferably includes a base having a reinforcement on which the plurality of knobs are disposed. The reinforcement is preferably a plurality of reinforcement fibers embedded in the base which run in at least one of the circumferential direction and the cross-wise direction. The base preferably has a thickness within a range from approximately 0.5–8 mm, particularly approximately 4 mm.

Each of the plurality of knobs preferably includes an inner gas cushion, such as an air cushion. The gas cushion is preferably ventilated from at least one of a side and a bottom of an associated one of the plurality of knobs.

Contact surfaces of the plurality of knobs may at least partially formed by a spike embedded in at least one of the plurality of knobs. The spike in at least one of the plurality of knobs may be slotted at least in a region of the contact surface. The plurality of reinforcing fibers are embedded in a matrix and preferably made of at least polyurethane.

A modulus of elasticity of the spike is preferably at least one order of magnitude higher than a material of the belt. The spike is preferably made of at least one of plastic, stainless steel, and ceramic.

The plurality of reinforcing fibers are preferably embedded in a matrix made of one of polyurethane and a combination of polyurethane and other materials.

The belt preferably includes at least one groove and a plurality of knobs formed on the first side of the belt. A depth of each of the at least one groove is preferably substantially identical to a height of each a plurality of knobs.

According to another embodiment of the invention, there is provided an endless belt for use in the production of a web of fibrous material. The belt has first and second sides. The first side is substantially open and the second side is substantially closed. The belt has a water storage capacity of at least 5 $l/m^2$. The belt also has a mean flexural rigidity for a circumferential and cross-wise directions of the belt, based on a distance of 1 meter in each direction, each of which is no greater than approximately 10 $Nm^2$; The belt also has a plurality of at least one of ribs and knobs on at least one of the first and second sides, with grooves defined therebetween. A total contact surface area of the plurality of at least one of ribs and knobs is no greater and 50% of a surface area of the belt.

BRIEF DESCRIPTION OF THE DRAWINGS

The present invention is further described in the detailed description that follows, in reference to the noted plurality of drawings by way of non-limiting examples of preferred embodiments of the present invention, in which like reference numerals represent similar parts through the several views of the drawings, and wherein.

DETAILED DESCRIPTION OF THE INVENTION

The particulars shown herein are by way of example and for purposes of illustrative discussion of the preferred embodiments of the present invention only, and represents in the cause of providing what is believed to be the most useful and readily understood description of the principles and conceptual aspects of the invention. In this regard, no attempt is made to show structural details of the invention in more detail than necessary for the fundamental understanding of the invention, the description taken with the drawings making apparent to those skilled in the art how the several forms of the invention may be embodied in practice.

Figure 1:
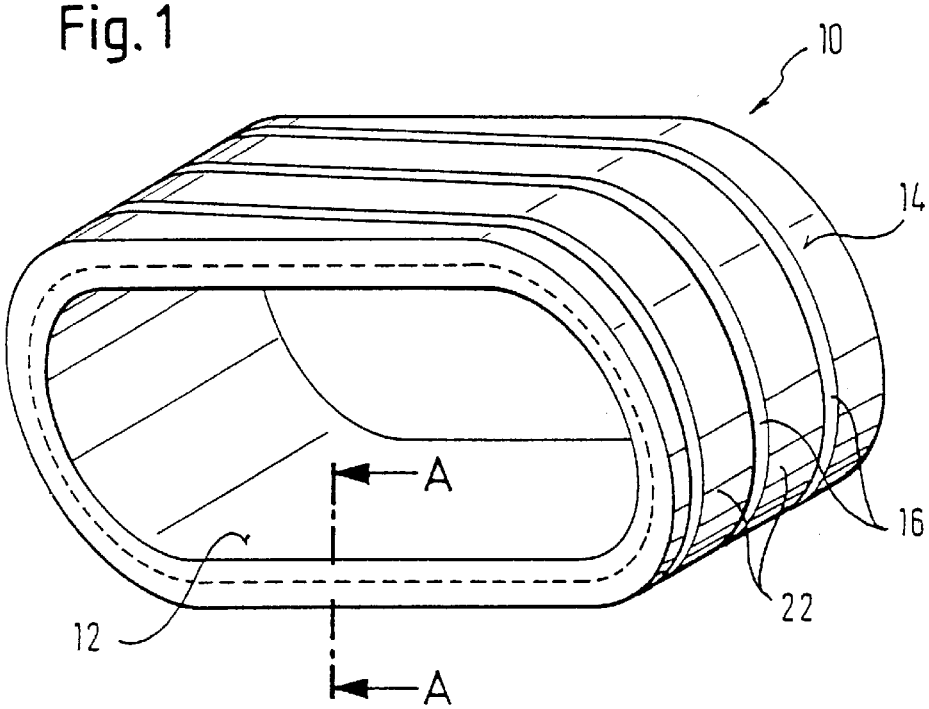
FIG. 1 is a perspective view of an exemplary embodiment of the present invention.
Figure 2:
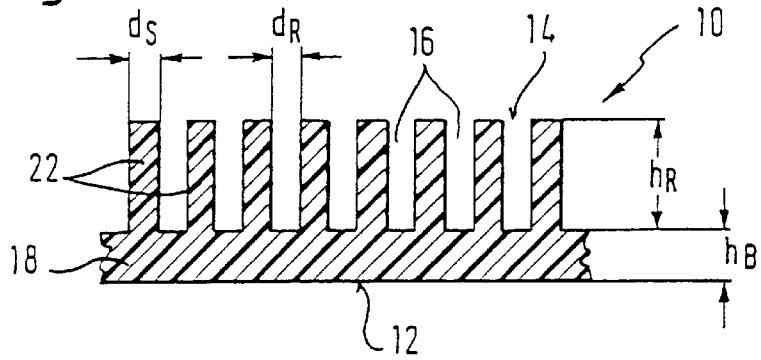
FIG. 2 is a cross-section of the belt, cut along the line II—II of FIG. 1.
Figure 3:
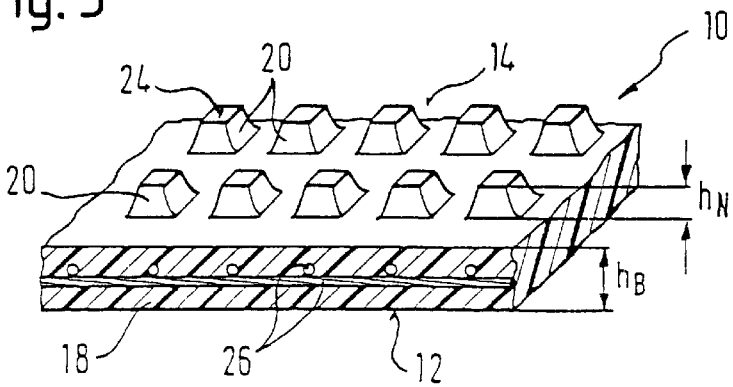
FIG. 3 is a perspective view of another embodiment of the present invention.

Referring to FIGS. 1 and 2, a first embodiment of an endless belt 10 is shown. Belt 10 can be used in the drainage section, particularly in the forming section, of a machine for the production of a web of fibrous material. The belt 10 has a substantially closed internal side 12 and a substantially open external side 14. Grooves 16 run in a spiral along external side 14, although grooves 16 may also be arranged to run in the circumferential and/or cross-wise direction. Referring now also to FIG. 3, grooves 16 are defined between either ribs 22 or knobs 20, or some combination of the two. Belt 10 includes a base 18, preferably provided with a reinforcement 26 (see also FIGS. 10 and 11), on which the ribs 22 or the knobs 20 provided between the grooves 16 are disposed. Knobs 20 and/or ribs 22 may be formed by machining base 18 to remove excess material.

In FIG. 2, the rib width is $d_S$, the groove width $d_R$, the height of the base 18 is $h_B$, and the height of each ribs 22 is $h_R$. If knobs 20 are present, the height of knobs 20 are $h_N$, such that the overall thickness of the belt 10 equals $h_N+h_B$.

The water storage capacity of the open side 14 of the endless belt 10 is at least 5 $l/m^2$, particularly within a range of from approximately 5–25 $l/m^2$, and preferably within a range of from approximately 10–18 $l/m^2$.

The belt 10 has mean flexural rigidity in the circumferential and cross-wise directions. Based on a distance of 1 m, the mean flexural rigidity in each of the noted directions is less than or equal to approximately 10 $Nm^2$. Here, flexural rigidity is the product E·I, where "E" is the modulus of elasticity (in $N/mm^2$) and "I" is the axial moment of inertia (in $m^4$). The flexural rigidity in the circumferential direction and the cross-wise direction may be the same or different.

The depth of each rib 22 $h_R$ and the height of each knob 20 $h_N$ are within a range from approximately 5–25 mm and, and particularly within a range of approximately 12–20 mm.

Figure 8:
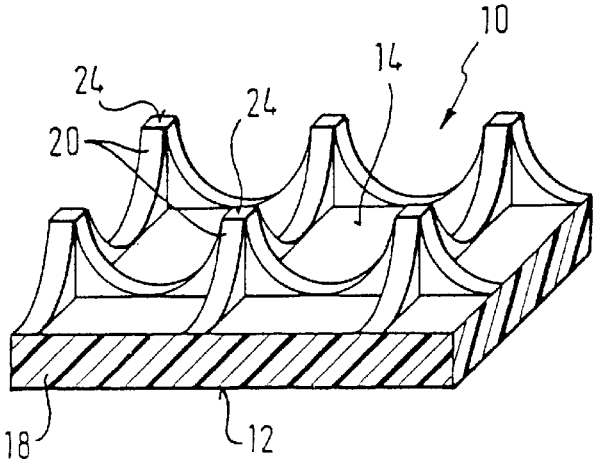
FIG. 8 is a schematic view of another embodiment of the present invention.

Referring now to FIGS. 3 and 8, knobs 20 may be disposed in rows running generally in the circumferential direction and/or generally in the cross-wise direction. In principle, the knobs 20 may also be disposed in a spiral.

An outer contact surface 24 of knobs 20, which can be brought into contact with a wire belt (see FIG. 16) is on the whole less than or equal to 50% of the overall surface of the belt 10, particularly within a range of from approximately 15–30%, and preferably within a range of from approximately 20–25% of the overall surface of the belt 10. In addition, the individual contact surfaces 24 preferably have no dimension greater than approximately 6 mm any direction, whereby the largest dimension is preferably approximately 2 mm. The individual contact surfaces 24 may, for example, be round, square, or rectangular, although other shapes may be used.

The endless belt 10 has a compressibility C of approximately 100–2000 kPa, whereby compressibility is defined by the following equations:

$$C=p/\delta$$

$$\delta=\Delta d/d$$

where:

p is a pressure per unit area on the entire surface of the belt in Pa

Δd is a decrease in thickness under a pressure per unit area p; and d is the unloaded total thickness of the belt in meters.

Figure 10:
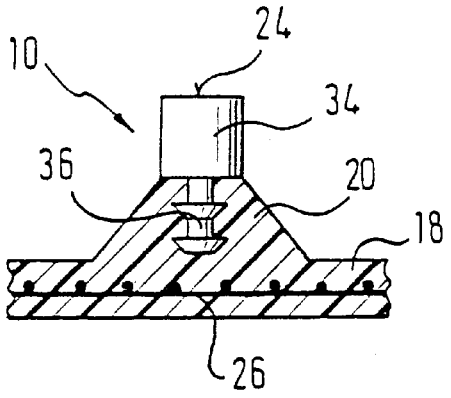
Figure 11:
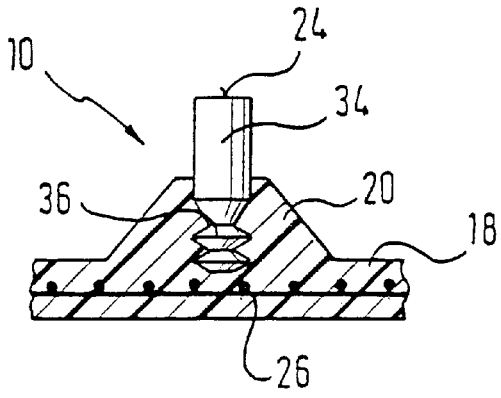
Figure 12:
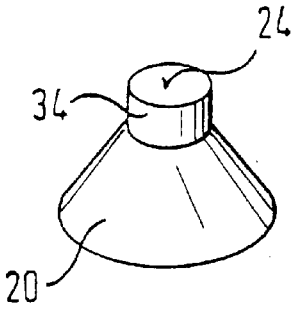
FIGS. 12 and 13 are perspective views of two different embodiments of a knob provided with a spike.
Figure 13:
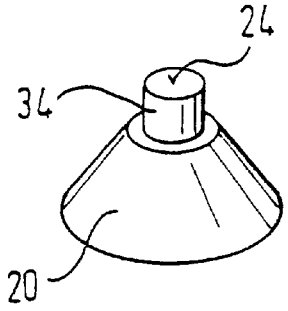

Referring now to FIG. 3, 10, and 11, base 18 of the endless belt 10 may have a matrix 26. Matrix 26 is preferably a series of reinforcement fibers embedded in belt 10, and which run in the circumferential and/or cross-wise directions of belt 10. Matrix 26 is preferably made of polyurethane, or a combination of polyurethane and other materials.

Figure 4:
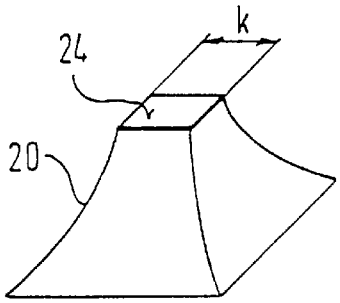
FIG. 4 is a schematic view of a single knob.

Referring now to FIG. 4, a knob 20 is shown with a square-shaped contact surface 24. It may, however, be other shapes, such as rectangular or round. The largest dimension k for the contact surface is preferably less than or equal to 6 mm, and preferably approximately 2 mm. The density of knobs 20 is set to meet the ratio of the total surface are of contact surfaces 24 to the entire belt 10, as discussed above.

The base 18 has a thickness $h_B$ within a range of approximately 0.5–8 mm, preferably approximately 4 mm.

Figure 5:
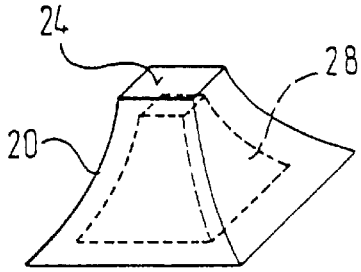
FIG. 5 is a schematic view of a knob provided with a gas cushion.
Figure 6:
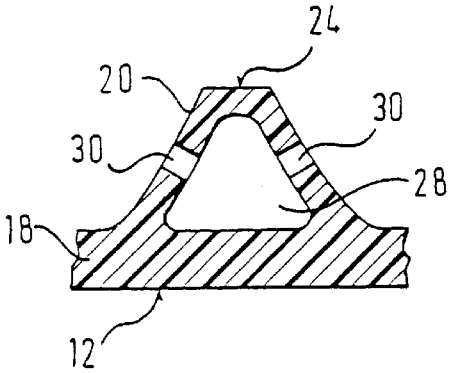
FIG. 6 is a schematic view of a knob with a side-ventilated gas cushion.
Figure 7:
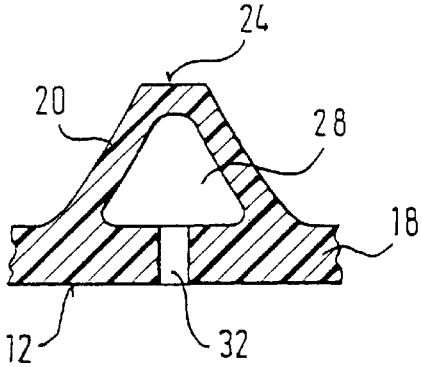
FIG. 7 is a schematic view of a knob ventilated toward the interior of the belt.

Referring now to FIGS. 5–7, some or all of knobs 20 may include an internal gas cushion 28, such as an air cushion. This gas cushion 28 may be ventilated, such as, for example, a side-ventilated gas cushion 28 (FIG. 6) where ventilation passes through side openings 30. FIG. 7 illustrates a knob 20 ventilated toward the bottom of the knob, where ventilation passes through at least one internal opening 32.

Figure 9:
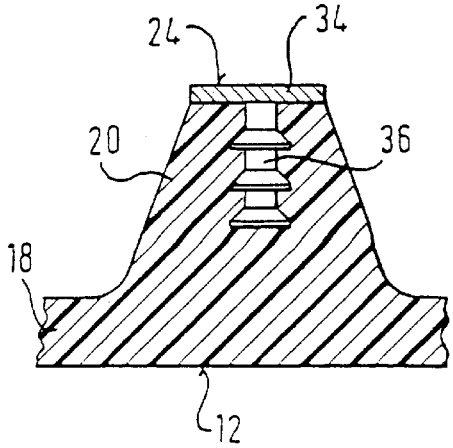
FIGS. 9–11 are sectional views of various embodiments of a knob provided with a spike.
Figure 14:
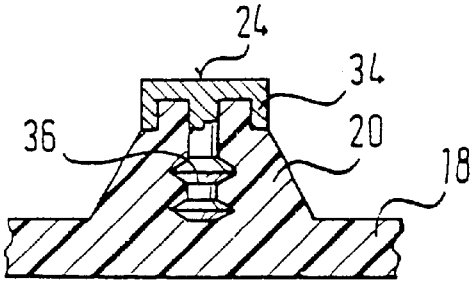
FIG. 14 is a cross-section of another embodiment of a knob with a spike with a generally T-shaped cross-section.

Referring now to FIGS. 9–15, the contact surfaces 24 of the knobs 20 may be formed by a spike 34 embedded in the knobs 20. In FIGS. 9 and 14, knobs 20 have a spike 34 with a generally T-shaped cross-section, whose external flat section forms the contact surface 24. In the embodiment of FIG. 9, contact surface 24 is completely flat and flush with the external edge of the tapered outer zone of the knob 20, while in the embodiment of FIG. 14 the edge of this external region of He spike 34 is turned inward over the associated edge of the outer zone of the spike 34. In contrast, in FIGS. 10 and 11, the external region of each spike 34 is shaped like a pin.

Knobs 20 can have an outward tapering cross-section. Referring now to FIG. 10, an external diameter of the outer pin-type section of the spike 34 is roughly the same size as the smallest external diameter of the conically tapering knob 20. In FIG. 11, the external diameter of the corresponding pin-type external section of the spike 34 is smaller than the smallest external diameter of the associated knob 20. The outward protruding spike section of the embodiment in FIG. 13 has a smaller diameter than that of the embodiment in FIG. 12.

As can be seen in FIGS. 9–11 and 14, the spikes 34 are preferably provided with expanded retaining sections 36 embedded in the knobs 20.

Figure 15:
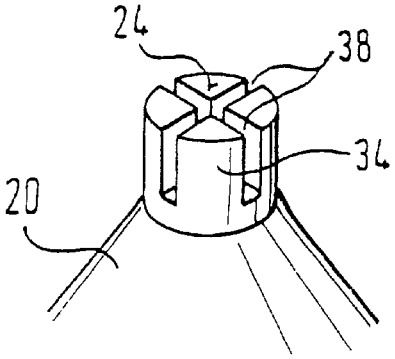
FIG. 15 is a cross-section of another embodiment of a knob with a slotted spike.

Referring now to FIG. 15, a slotted spike 34 can be used. In this embodiment, the spike 34 has a crossed recess 38 and a round cross-section. However, a slotted embodiment may, in principle, also be provided with spikes of a different cross-section, such as a rectangular or square cross-section.

Figure 16:
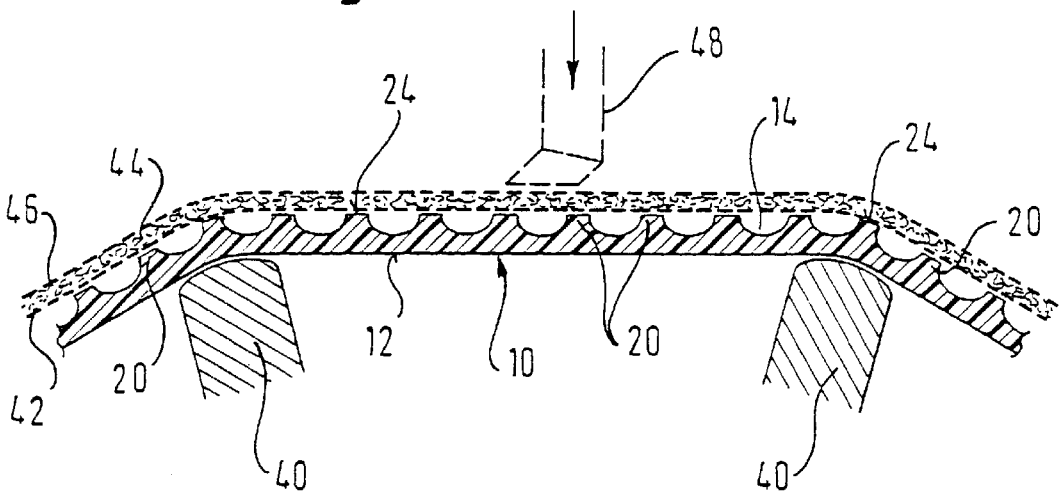
FIG. 16 is a cross-section of an exemplary embodiment of a forming section of a paper machine with the present invention.
Figure 17:
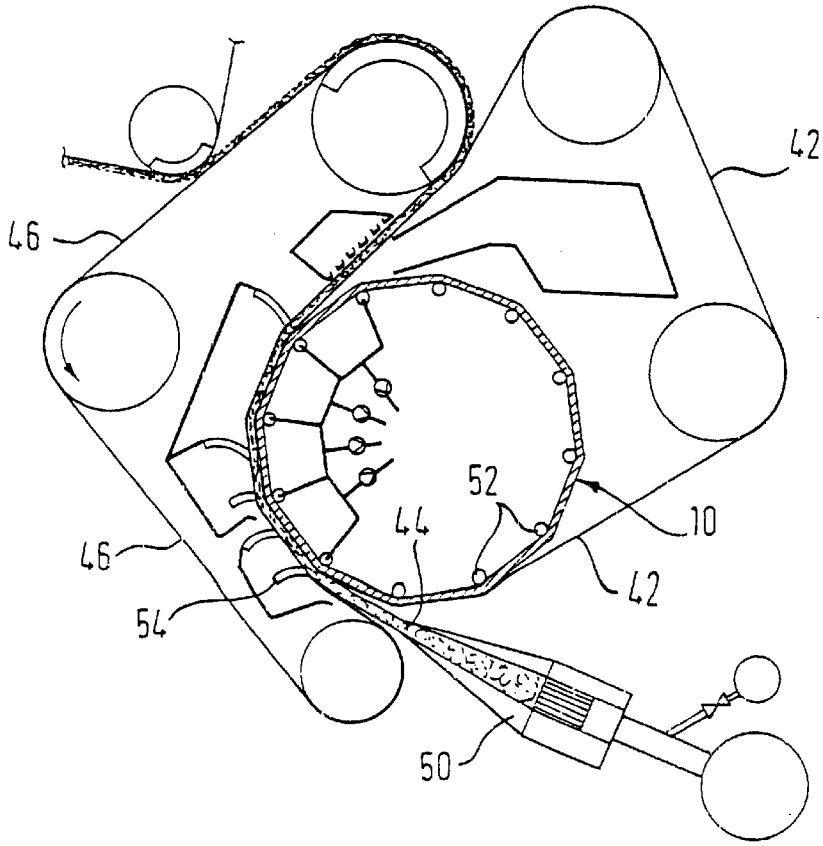
FIG. 17 is a cross-section of another exemplary embodiment of a forming section of a paper machine with the present invention.

Exemplary applications for an endless drainage and support belt 10 designed as above are shown in FIGS. 16 and 17. In FIG. 16, internal side 12 of belt 10 is guided over supporting rails 40 and supports an inside wire belt 42 making contact with its open external side 14. Here, inside wire belt 42 lies against the contact surfaces 24 of the knobs 20. The pulp suspension 44 is guided between the inside wire belt 42 and an outside wire belt 46. The outside wire belt 46 may be acted upon by at least one forming blade 48.

In FIG. 17, the pulp suspension 44 coming from a headbox 50 is introduced into the intake gap between outside wire belt 46 and an inside wire belt 42 supported by circulating endless belt 10, and which is guided by a plurality of internal rolling support elements 52. In the support zone, formation blades 54, which can be either continuous or sectioned, can be pressed against the outside wire belt 46. Accordingly, the endless belt 10 serves both as a support belt for the inside wire belt 42 and as a drainage belt.

It is noted that the foregoing examples have been provided merely for the purpose of explanation and are in now way to be construed as limiting of the present invention. While the invention has been described with reference to one or more preferred embodiments, the invention is not so limited, and various modification fall within He scope and spirit thereof.

List of Reference Designators

10 endless belt
12 internal side
14 external side
16 grooves
18 base
20 knobs
22 ribs
24 contact surface
26 reinforcement
28 gas cushion
30 side opening
32 inside opening
34 spike
36 retention section
38 crossed recess
40 supporting rail
42 inside wire
44 pulp suspension
46 outside wire
48 forming rail
50 headbox
52 support elements
54 formation rails
$h_B$ height of base
$h_N$ height of knobs
$h_R$ height of ribs
k largest dimension

What is claimed:

1. An endless belt for use in the production of a web of fibrous material, comprising:

first and second sides, said first side being substantially open and said second side being substantially closed;

a water storage capacity of at least approximately 5 $l/m^2$; and a mean flexural rigidity for a circumferential direction and cross-wise direction of said belt, each of which is no greater than approximately 10 $Nm^2$ per one meter distance.

2. The endless belt of claim 1, wherein said water storage capacity is between approximately 5–25 $l/m^2$.

3. The endless belt of claim 1, wherein said water storage capacity is between approximately 10–18 $l/m^2$.

4. The endless belt of claim 1, wherein said mean flexural rigidity in said circumferential direction equals said mean flexural rigidity in said cross-wise direction.

5. The endless belt of claim 1, wherein said mean flexural rigidity in said circumferential direction does not equal said mean flexural rigidity in said cross-wise direction.

6. The endless belt of claim 1, further comprising at least one groove formed on said first side.

7. The endless belt of claim 6, wherein at least one of said at least one groove runs in said circumferential direction.

8. The endless belt of claim 6, wherein at least one of said at least one groove runs in said cross-wise direction.

9. The endless belt of claim 6, said at least one groove comprising a plurality of grooves, at least one of said plurality of grooves running in said circumferential direction, and at least another of said plurality of grooves running in said cross-wise direction.

10. The endless belt of claim 6, wherein said at least one groove runs in a spiral direction.

11. The endless belt of claim 6, wherein at least one of said at least one groove has a depth within a range from approximately 5–25 mm.

12. The endless belt of claim 11, wherein said depth is within a range of from approximately 12–20 mm.

13. The endless belt of claim 1, further comprising a plurality of knobs on said first side.

14. The endless belt of claim 13, wherein said plurality of knobs are disposed in rows running substantially in both said circumferential direction and said cross-wise direction.

15. The endless belt of claim 14, wherein said plurality of knobs are disposed in a spiral.

16. The endless belt of claim 13, wherein an outer contact surface of said plurality of knobs is adapted to be brought into contact with a wire belt, and a total surface area of a contact surface of said plurality of knobs is no greater than 50% of the total surface area of said endless belt.

17. The endless belt of claim 16, wherein said total surface area of said contact surface of said plurality of knobs is within a range of approximately 15–30% of the total surface area of said endless belt.

18. The endless belt of claim 16, wherein said total surface area of said contact surface of said plurality of knobs is within a range from approximately 20–25% of the total surface area of said endless belt.

19. The endless belt of claim 16, wherein each contact surface of said plurality of knobs has a maximum dimension of approximately 6 mm in any direction.

20. The endless belt of claim 19, wherein a largest dimension of any contact surface of said plurality of knobs is approximately 2 mm.

21. The endless belt of claim 16, wherein each contact surface of said plurality of knobs has one of a round, square, and rectangular shape.

22. The endless belt of claim 1, wherein said belt has a compressibility of between approximately 100–2000 kPa.

23. The endless belt of claim 13, wherein said belt includes a base having a reinforcement on which said plurality of knobs are disposed.

24. The endless belt of claim 23, wherein said reinforcement comprises a plurality of reinforcement fibers embedded in the base which run in at least one of said circumferential direction and said cross-wise direction.

25. The endless belt of claim 23, wherein said plurality of knobs are formed by machining said base to remove excess material.

26. The endless belt of claim 23, wherein said base has a thickness within a range from approximately 0.5–8 mm.

27. The endless belt of claim 23, wherein said base has a thickness of approximately 4 mm.

28. The endless belt of claim 23, wherein each of said plurality of knobs includes an inner gas cushion.

29. The endless belt of claim 28, wherein said inner gas cushion is an air cushion.

30. The endless belt of claim 29, wherein said inner gas cushion is ventilated from at least one of a side and a bottom of an associated one of said plurality of knobs.

31. The endless belt of claim 13, wherein contact surfaces of said plurality of knobs are at least partially formed by a spike embedded in at least one of said plurality of knobs.

32. The endless belt of claim 31, wherein said spike in at least one of said plurality of knobs is slotted at least in a region of said contact surface.

33. The endless belt of claim 31, wherein a modulus of elasticity of said spike is at least one order of magnitude higher than a material of said belt.

34. The endless belt of claim 31, wherein said spike is made of at least one of plastic, stainless steel, and ceramic.

35. The endless belt of claim 1, further comprising at least one groove and a plurality of knobs formed on said first side, a depth of said at least one groove being substantially identical to a height of each of said plurality of knobs.

36. The endless belt of claim 24, wherein said plurality of reinforcing fibers are embedded in a matrix made of one of polyurethane and a combination of polyurethane and other materials.

37. The endless belt of claim 1, wherein said mean flexural rigidity is based on a width of at least 1 meter.

38. An endless belt for use in the production of a web of fibrous material, comprising:

first and second sides, said first side being substantially positioned to receive drainage fluid and having a water storage capacity of at least approximately 5 $l/m^2$; and said belt having a mean flexural rigidity for a circumferential and cross-wise directions of said belt each of which is no greater than approximately 10 $Nm^2$.

39. The endless belt of claim 38, further comprising:

a plurality of at least one of ribs and knobs on at least one of said first and second sides, with grooves defined therebetween; and a total contact surface area of said plurality of at least one of ribs and knobs being no greater and 50% of a surface area of said belt.

* * * * *